United States Patent [19]

Shaw

[11] Patent Number: 4,863,156

[45] Date of Patent: Sep. 5, 1989

[54] TRAMPOLINE SUSPENSION SYSTEM

[75] Inventor: James L. Shaw, Bluffdale, Utah

[73] Assignee: Weslo, Inc., Logan, Utah

[21] Appl. No.: 175,690

[22] Filed: Mar. 22, 1988

Related U.S. Application Data

[63] Continuation of Ser. No. 828,493, Feb. 11, 1986, abandoned.

[51] Int. Cl.[4] ..... A63B 5/00

[52] U.S. Cl. ..... 272/65

[58] Field of Search ..... 272/69, 70, 97, 65, 272/66, 93; 128/25 R; 182/137, 138, 139; 160/339, 402, 392, 395, 398, 401; 5/110, 111, 112, 113, 114

[56] References Cited

U.S. PATENT DOCUMENTS

| | | | |
|---|---|---|---|
| 2,294,509 | 9/1942 | Moeller | 182/139 |
| 2,370,990 | 3/1945 | Nissen | 272/65 |
| 2,792,612 | 5/1957 | Wickliffe | 160/402 X |
| 3,142,880 | 8/1964 | Davies | 160/402 X |
| 3,983,585 | 10/1976 | Sidlinger | 272/65 X |
| 4,452,444 | 6/1984 | Schulze | 272/65 |

FOREIGN PATENT DOCUMENTS

| | | | |
|---|---|---|---|
| 256293 | 2/1964 | Australia | 272/65 |
| 1248909 | 10/1971 | United Kingdom | 272/65 |

*Primary Examiner*—V. Millin
*Assistant Examiner*—S. R. Crow
*Attorney, Agent, or Firm*—Trask, Britt & Rossa

[57] ABSTRACT

A trampoline includes a sheet resiliently supported and tensioned by a substantially rigid frame through means of spring-like members positioned about the perimeter of the sheet. The spring-like members are connected to the sheet through means of a compressive fastener adapted to receive a turned-over edge of the sheet. The turned-over edge of the sheet defines a channel in which a filler, such as a cable, is placed. The fastener compressively retains the turned-over edge together with the cable.

11 Claims, 3 Drawing Sheets

TRAMPOLINE SUSPENSION SYSTEM

This application is a continuation of application Ser. No. 828,493, filed 2/11/86 now abandoned.

BACKGROUND OF THE INVENTION

1. Field

This invention relates to trampoline recreational equipment. Specifically, this invention is directed to a resilient trampoline suspension system for use in connecting an essentially stretchless jumping platform to a rigid support frame.

2. State of the Art

Trampolines of various configurations are well-known in the art. A typical construction includes a sheet of fabric which is generally quadrilateral or circular in shape. The sheet defines a jumping surface and is tensionally suspended in a substantially horizontal plane from an essentially rigid or sometimes resilient frame structure. The fabric sheet is traditionally connected to the frame by means of an elastic suspension or connection system; e.g., coil springs connected to the sheet along its edge. The springs are used to tension the sheet essentially taut while also imparting an elastic quality to the sheet/spring assembly.

Many traditional means of connecting the springs to the sheet of fabric have proven less than satisfactory in achieving a connection which is both easily manufactured and durable over an extended use period. For example, in one known connection arrangement, the edge of the sheet of fabric is turned under to form a hem which is stitched by a conventional sewing operation. The hemmed edge is utilized as a mounting platform for a securement ring, which ring is adapted in turn for connection to a coil spring. Typically, the ring is connected to the hemmed edge by an elongated fabric strip which passes through the ring. The proximal and distal ends of the strip are thereafter sewn to the hemmed edge, securing the ring to the fabric sheet. Generally, a further strengthening of the mounting platform is accomplished by adding a reinforcing piece of fabric proximate the hemmed edge of the fabric sheet. The sewing thread, in connecting the various fabric members, passes through the doubled layer of the sheet of fabric, the ring-retaining fabric strip, and then the reinforcement fabric. Noticeably, the manufacture and installation of this mounting means is time-consuming in terms of manufacturing requirements.

In an alternate arrangement, the fabric sheet is connected to the springs via metal eyelets which are positioned in the fabric sheet along its perimeter. The eyelets individually define an aperture adapted to receive and retain a hook-like structure affixed to the coil springs.

A trampoline constructed under either of these methods presents disadvantages in use. First, trampolines placed outdoors are subjected to ultraviolet radiation from exposure to the sun. The ultraviolet rays induce a deterioration of the strong synthetic threads presently used in constructing trampolines. Under typical outdoor use conditions, a spring/fabric connection constructed as first described above is believed to have a useful life of approximately two years. Even in those applications where special ultraviolet-resistant thread is used, the thread may deteriorate, though at a somewhat slower rate.

Another disadvantage in the described methods is the limited capability of conventional connection arrangements to distribute the forces transferred by the coil springs to the fabric sheet. In typical use, the conventional connection arrangement transfers the force to substantially small areas along the edge of the sheet of fabric. In the case of the ring and fabric strip arrangement, the force is transmitted at the junction of the ends of that strip and the fabric sheet. In the eyelet arrangement, the force is applied about the circumference of the eyelet. This concentrated force application often exceeds the tensile strength of the fabric in those small areas and may therefore result in distortion or unravelling of the weave of the fabric sheet in extended use.

Given the danger which may result from a deteriorating connection structure, the user is impelled by safety considerations to periodically inspect and repair where necessary and in some cases replace the entire sheet of fabric. Recognizably, this replacement results in a considerable cost for the user.

SUMMARY OF THE INVENTION

A trampoline sheet is tensionally suspended in a generally horizontal plane upon a structural frame. The sheet may be configured in a variety of shapes (e.g., circular, quadrilateral, hexagonal, octagonal). A filler is positioned proximate the ede; and the edge with filler is positioned within a fastener for connection to the frame of the trampoline via springs. In a preferred embodiment, the edge or edges of the sheet are "turned over". That is, the edge is turned back on itself in a manner similar to that adopted by a tailor in making a hem. The turned-over edge or edges define a hollow channel. A filler such as a rope or cable is placed within the hollow channel.

A plurality of integral, "C"- or "U"-shaped fasteners, each having a pair of compressible jaws, are positioned in a spaced, predetermined relationship about the edge of the sheet. Each fastener defines an open-sided chamber or channel dimensioned to snuggly receive the turned-over edge of the sheet together with the rope enclosed thereby. In one embodiment, the fasteners may be fabricated from a material which is inelastically deformable under a moderate force application. They may also be formed of an elastically deformable material. The fasteners are secured to the sheet edge by compressing the jaws of each fastener about the edge and filler within the channel defined by the fastener.

Each fastener includes means for attachment coil springs or other suspension means which interconnect the frame with the sheet.

DESCRIPTION OF THE ILLUSTRATED EMBODIMENTS

Figure 1:
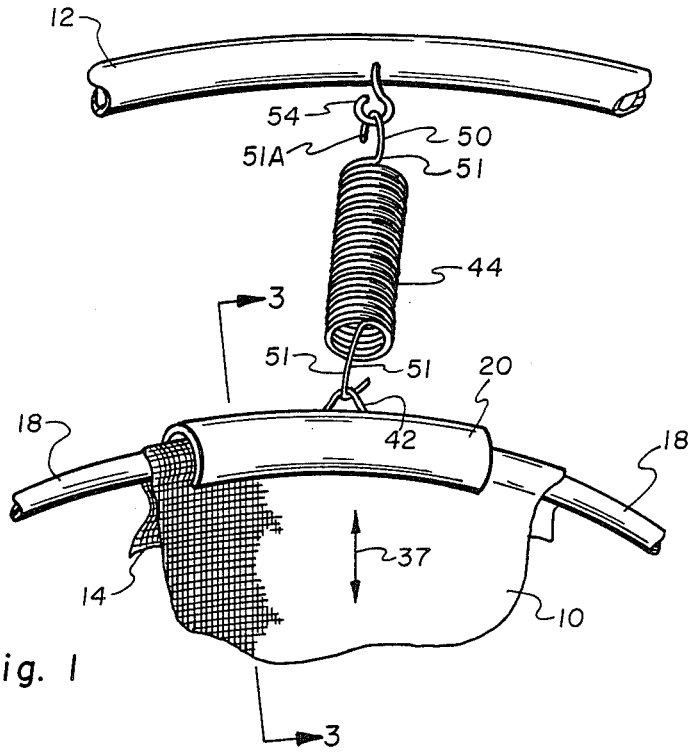
FIG. 1 is an elevated perspective view with cut-away segments of a trampoline suspension system according to the invention.
Figure 4:
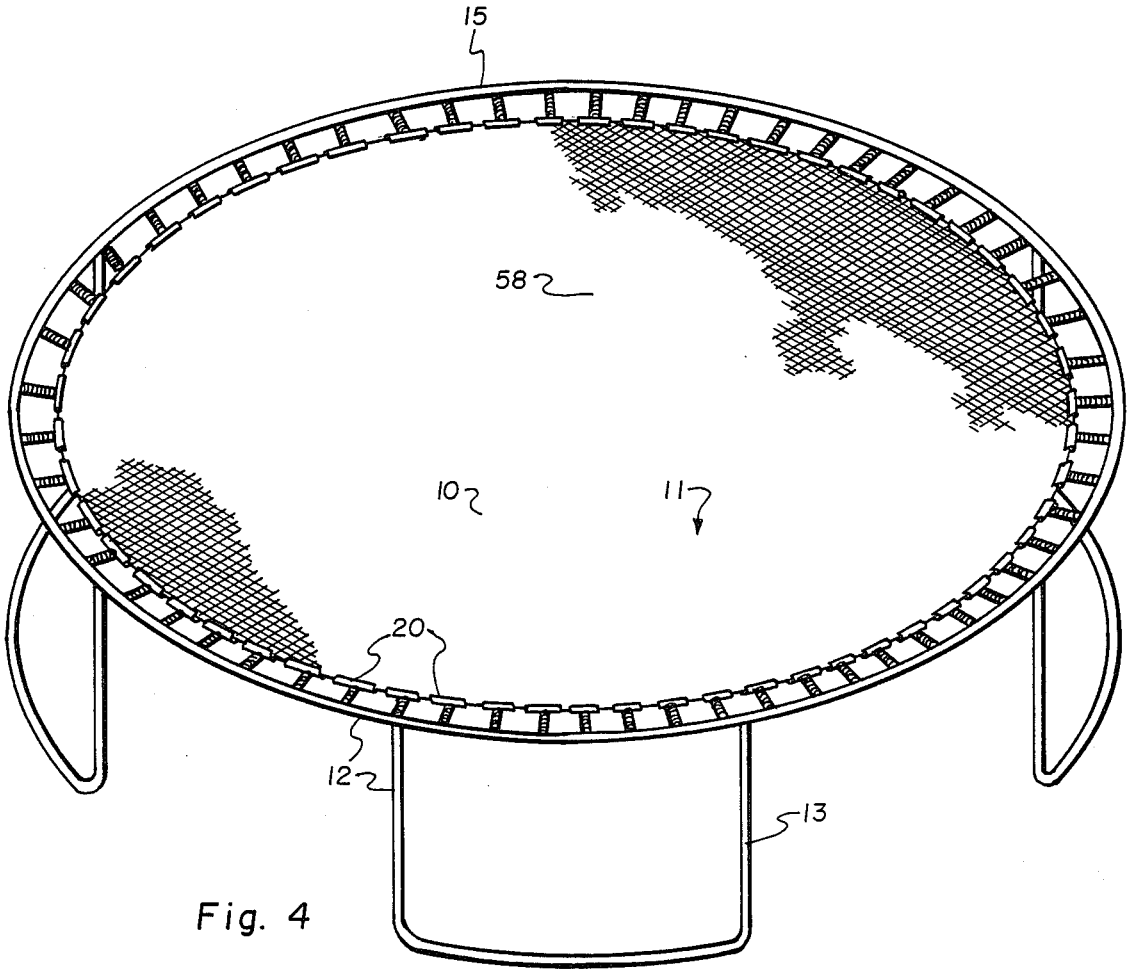
FIG. 4 is an elevated view of a trampoline constructed in accordance with the invention.

As shown in FIGS. 1 and 4, a trampoline constructed in accordance with this invention includes a sheet 10 having dimensions and a shape corresponding to the interior area 11 defined by a substantially rigid frame structure 12 which is here shown to have ground supports 13 which support a frame member 15. Sheet 10 is typically a fabric formed of various compositions of nylon, polypropylene, or a similar durable material, well-known in the art. The sheet 10 has an edge or edges 14 about the perimeter of the sheet. The sheet 10 may also be fabricated from other materials such as rubber or synthetic materials that are not woven.

For purposes of this description, sheet 10 is shown with a single edge 14 which defines its perimeter. Though this description is directed principally to a single-edged sheet, this approach should not be understood to restrict the application of this invention to single-edged sheets. It should be understood that a variety of sheet shapes are within contemplation; e.g., circular sheets having a perimeter defined by essentially one continuous edge, or polygonal sheets having a perimeter composed of a plurality of edges. Therefore, the term "edge" as used herein should be understood to include single-edge as well as multi-edge applications.

In a preferred embodiment of the invention, the edge 14 of the sheet 10 is turned over. That is, the edge 14 is preferably turned back on the sheet 10 itself, in a manner similar to that used by a tailor in making a hem in a garment. The turned-over edge of the sheet increases the thickness of the sheet proximate the edge. The increased thickness permits the use of a compressible or crimpable fastening means 20 which substantially encompasses the thickened portion of the sheet.

Figure 3:
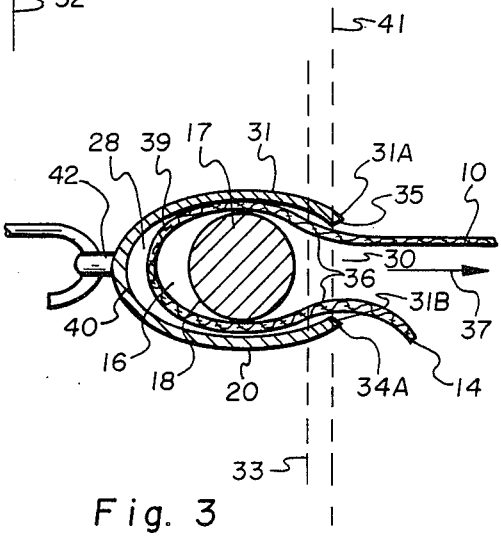
FIG. 3 is a cross-sectional view of a fastening means of this invention in conjunction with a jumping platform and cable member.

When the edge 14 of sheet 10 is turned over, a channel 16 is formed which extends around the perimeter of sheet 10. In cross-section, the channel 16 may be of any desired configuration and is shown in FIG. 3 to be essentially oval. Positioned within channel 16 is a filler means 18 which also may be of any cross-sectional configuration (here shown to be generally circular in cross-section). The filler means 18 may be any material of substantially solid construction (e.g., metal cable or wire rope) or slightly compressible (e.g., hemp or nylon rope). The filler means 18 illustrated in FIG. 3 is a conventional cable or rope 17 which is preferably essentially circular in cross-section and sized in cross-section to fit snugly in the channel 16 formed by turning over the edge 14. In one embodiment, the filler means 18 extends continuously through the channel 16 around the entire perimeter of the sheet 10. Alternately, the filler means 18 may consist of a plurality of individual segments or portions positioned in space relationship to each other and positioned to substantially register with the fastening means 20.

The filler means 18 acts as a spacer and as a filler to fill the fastening means 20 as more fully discussed hereinafter. The filler means 18 is deformable or compressible to the extent necessary to conform to the fastening means 20 but yet sufficiently strong to absorb forces transmitted thereto in use. The filler means 18 is also preferably axially flexible to readily conform to the selected perimeter shape or configuration of the edge 14 of the sheet 10 and to flex with the uneven force loading when in use.

It should be understood that even though in a preferred embodiment the edge 14 is turned over to form channel 16, in another embodiment the edge 14 may simply be positioned with the filler means 18 proximate thereto so that upon crimping of the fastening means 20 (as hereinafter discussed), the edge 14 is positioned approximately as shown at 19 in FIG. 3. That is, the edge 14 is positioned about the surface of the filler means 18 so that upon compression of the fastening means 20, the edge 14 is past the midpoint of the filler means 18 and surrounds a substantial portion of the filler means 18 as illustrated in FIG. 3 with the edge 14 at the position shown at the line with numeral 19. With the edge 14 so positioned, the tensile forces in the sheet 10 during use can be transmitted to the filler means 18 and the fastening means 20.

Figure 2:
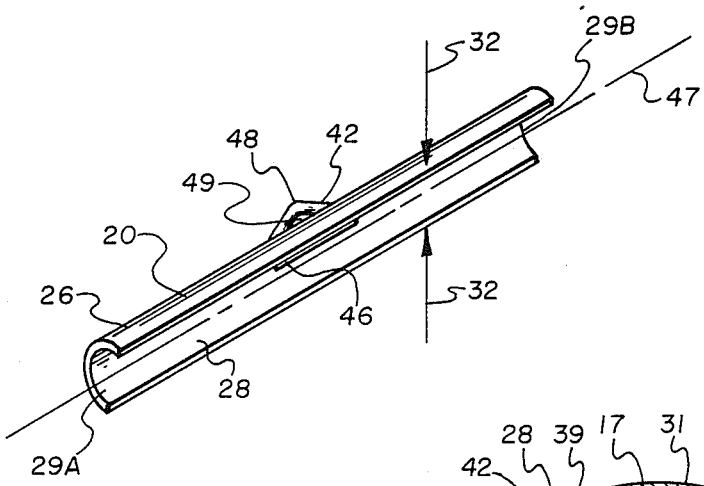
FIG. 2 is a perspective view of a fastening means of the invention showing the interior recessed chamber of that fastening means.

A plurality of fastening means 20 are crimped or clamped onto the edge of the sheet 10, preferably at spaced intervals. The fastening means may be arcuate (FIG. 1) or straight (FIG. 2) to conform to the selected perimeter shape or configuration of the sheet 10. As shown in FIG. 2, the fastening means 20 may be a member 26 formed to be tube-like and to have open sides so that it is essentially "C"- or "U"-shaped in cross-section along its length. Member 26 has an open-sided hollow channel 28 in the interior thereof. Channel 28 may be formed in a variety of configurations. As shown in FIG. 3, the channel 28 is substantially eliptical in cross-section. Member 26 has open ends 29A and 29B and a slot-like aperture 30 which extends along the full length of the fastening means. Aperture 30 is in most part defined by the jaws 31A and 31B. Channel 28 and aperture 30 are dimensioned to snuggle receive the filler means 18 and edge 14, positioned at 19 as hereinbefore discussed, or the turned-over edge 14 of the sheet 10 as shown in FIG. 3.

After the turned-over edge of the sheet 10 is positioned within the channel 28, a compressive force is applied in the directions indicated generally by arrows 32 (FIG. 2), thereby effecting a crimping or clamping action. The force can be applied by any available crimping tool or by nuts, bolts or clamps as desired. The fastening means 20 may be constructed of a material (e.g., aluminum, soft steel) which inelastically bends under the compressive force and thereafter retains the crimped configuration. A choice of materials which are inelastically bendable under moderate force applications is preferred in that this choice permits construction of a fastening means which is easily attached and yet capable of remaining securely in place about the enclosed turned-over edge 14 of the sheet 10 upon the release of the compressive force. A ferric metal is presently contemplated because of availability and cost. Alternatively, the fastening means may be constructed of materials that elastically deform and are compressed by clamps, a nut and bolt arrangement, or similar arrangement to cause the jaws 31A and 31B to come together to crimp onto the sheet 10. It should also be noted that although a plurality of fastening means 20 positioned in spaced relation are shown in FIG. 4, a single fastening means may be formed (e.g., out of durable plastic) to conform with the perimeter of the sheet 10 and crimped or fastened about the filler means 18 and edge 14 as hereinbefore discussed by use of nuts, bolts, clamps, or the like.

Figure 5:
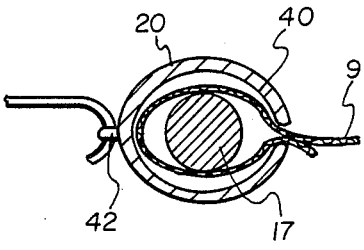
FIG. 5 is a cross-sectional view of a fastening means of this invention in a closed, clamped position.

When the jaws 31A and 31B of the fastening means 20 are compressed or crimped into their locking position, aperture 30 is reduced in size. The jaws 31A and 31B are brought into sufficient proximity that the filler means 18 and edge 14 cannot escape through the narrowed aperture 30 during the trampoline's use. Preferably, the jaws 31A and 31B are positioned about the sheet 10 and filler means 18 to extend beyond the location designated by line 33 in FIG. 3 so that the filler means 18 is not between the jaws 31A and 31B. Such an arrangement provides for the jaws 31A and 31B to be brought into close proximity, with generally only the sheet 10 separating the jaws 31A and 31B, as shown in FIG. 5.

Figure 6:
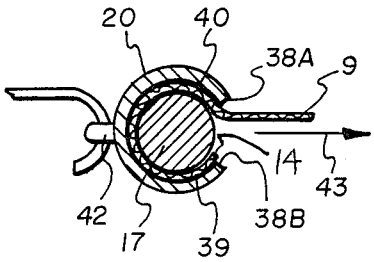
FIG. 6 is a cross-sectional view of an alternate fastening means of this invention in a closed, clamped position.

Alternately, the jaws 31A and 31B may be dimensioned so that, upon being clamped into their closed position, they extend over a substantial portion of the circumference of the cable/sheet edge assembly, but not over the complete circumference. This alternate construction is shown in FIG. 6.

Figure 7:
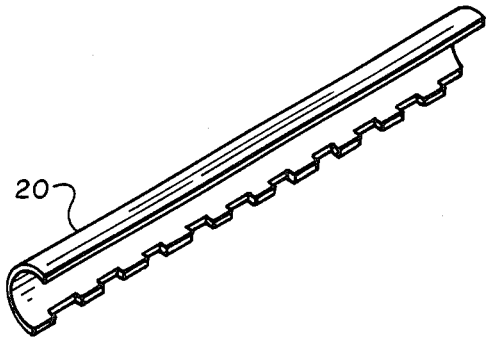
FIG. 7 is an elevational view of a fastening means of this invention.

The jaws 31A and 31B have interface surfaces 35. Interface surfaces 35 may be formed to present a variety of contact surfaces with the sheet when the jaws are brought into crimped proximity with the sheet. Preferably, the surfaces 35 are substantially planar, thereby achieving an essentially continuous jaw-sheet contact over the length of the surface of the jaws 31A and 31B. Alternately, the planar continuity of surfaces 35 may include interruptions such as the toothed or notched arrangement shown in FIG. 7 which provides for additional gripping points to grip the sheet 10.

Interface surfaces 35 may be rounded along their edges, generally 34A and 34B. The rounded edges 34A and 34B are preferable to minimize the risk of cutting or tearing of the sheet 10 after the jaws 31 are crimped onto the sheet 10.

Functionally, the jaws 31A and 31B are preferably brought into a compressive association against a portion 36 of the sheet 10. This compressive action results in high frictional force being established between the jaws 31 and the sheet 10.

When the trampoline is used, tensile forces are generated on the sheet 10 in the direction indicated generally at arrow 37. The frictional force generated between the jaws 31 and the sheet 10 with the filler means 18 prevents the sheet 10 from disengaging from the fastening means 20 due to the tensile forces 37.

Channel 28 is configured to essentially correspond to the outer shape of the turned-over edge 14 and enclosed filler means 18. This configuration results in a high friction force between the portion 39 of the sheet enclosed within channel 28 and the interior wall 40 of fastening means 20, as well as between sheet portion 39 and filler means 18 upon the application of a force applied to the sheet 10 in a direction generally indicated by vector 43.

In the embodiment shown in FIG. 6, the jaws 38A and 38B may be positioned such that in the closed, clamped position, they are compressed against the filler means 18 and edge 14 in contrast to being brought into an opposing placement about the double layer of sheet 10 as shown in FIGS. 3 and 5. The embodiment shown in FIG.3 includes a pair of jaws 31A and 31B which are positioned about the filler means 18 and edge 14 such that jaws 31A and 31B are brought into opposition essentially along an axis 41.

In a preferred embodiment, the fastening means 20 are approximately four inches (4") in length and are spaced approximately three-eighths inch ($\frac{3}{8}$") apart about the edge of the sheet. The spacing allows a small portion of the sheet edge 14 to remain free of the fastening means 20, permitting the sheet 10 some flexibility so that it may be folded for storage. The fastening means 20 has considerable contact with the edge 14 of the sheet 10 which enlarges the amount of edge 14 of the sheet 10 on which tensile forces are transmitted by the fastening means 20 in comparison with traditional attachment means. Though the spacing between the fastening means 20 permits the folding of the sheet, an alternate construction includes an essentially contiguous placement of the individual fastening means whereby essentially the total perimeter or circumference is utilized for purposes of distributing the applied tensile forces.

Fastening means 20 also include a connection means 42 for interlinking, either permanently or removably, the spring means 44 with fastening means 20. Various connection means are within contemplation. As shown, the connection means 42 may be of a triangular cross-sectioned metallic harness configured to have a base member 46 positioned on the member 26 parallel to the longitudinal axis 47 of the member 26. The harness 45 may include an apex-angled metallic member 48 secured to base member 46. The assembly of base member 46 and angled member 48 defines an aperture 49. Aperture 49 is dimensioned sufficiently large to receive a hook-like extension or other connection means 50 affixed to the spring means 44.

Connection means 42 may be affixed to the fastening means 20 at a variety of locations. The preferred location, as shown in FIGS. 2 and 3, is midway between the ends 29A and 29B of the member 26 and substantially opposite the slot 30. In a preferred embodiment, the connection means may be located diametrically opposite the slot 30, across the diameter of channel 28.

Spring means 44 may assume a variety of configurations. As shown in FIG. 1, spring means 44 may be a plurality of conventional coil springs, each having a connection means 50 located on each end. Connection means 50 may be a hook-like wire extension 51 formed from the wire constituting the coil spring itself. Wire extension 51A is dimensioned to be received within aperture 49 so as to secure the extension 51 to the member 26. Extension 51A is dimensioned tio be received in a connection means 54, which is firmly affixed to member 15 of frame 12. As shown, connection means 54 may include an aperture defined within the structure of member 15, dimensioned to receive and secure extension 51. FIG. 4 illustrates the assembly of spring means 44, sheet 10 and frame 12. As shown, the spring means 44 are dimensioned to facilitate a tensioned and resilient relationship between the sheet 10 and the frame 12 in a manner well-known in the art.

It is to be understood that the embodiments herein described are merely illustrative of the principles of the invention. Reference herein to the details of the illustrated embodiment is not intended to limit the scope of the claims which themselves recite those features regarded as essential to the invention.

I claim:

1. A trampoline comprising:

a frame defining a support area;

a trampoline sheet positioned within said support area said sheet having an edge;

filler means for providing a fastening base said filler means being positioned on said sheet proximate said edge; and a plurality of unitarily formed fastening members, each of said fastening members being formed with a channel which snugly receives said filler means together with said edge, each of said fastening members being shaped and formed to inelastically deform about said filler means and edge upon application of a clamping force applied by tool means external from each of said fastening members; and a plurality of spring members each said spring member being mounted to said frame and a respective fastening member for resillient interconnecting each of said fastening members to said frame to tensionally retain said sheet within said support area.

2. The trampoline of claim 1 wherein said plurality of fastening members are crimped in a spaced relationship along said edge of said sheet.

3. The trampoline of claim 2 wherein said edge of said sheet is turned over to form a channel, and wherein said filler means is comprised of a plurality of individual filler segments, each positioned within a said channel of each of said fastening members.

4. The trampoline of claim 2 wherein said filler means is a cable or rope and wherein said fastening members are formed to "C"-shaped in cross-section.

5. The trampoline of claim 4 wherein said spring means has two ends and hook-like structure at each of said ends, wherein said fastening members have structure to receive one of said hook-like structures and wherein said frame has means mechanically associated therewith to receive one of said hook-like structures.

6. The trampoline of claim 5 wherein each of said fastening members includes a ring-like structure fixedly adapted thereto for connecting said spring members thereto.

7. The trampoline of claim 6 wherein each of said fastening members is approximately four inches (4") in length and is positioned approximately three-eights inch ($\frac{3}{8}$") from an adjacent fastening member.

8. The trampoline of claim 5, wherein said spring members are a plurality of coiled spring members.

9. The trampoline of claim 4, wherein said fastening members have rounded edges which make contact with said sheet.

10. A trampoline comprising:

a frame;

a sheet positioned within said frame, said sheet having an edge which is turned over to form a sheet channel about the perimeter of said sheet;

filler means for providing a fastening base and positioned within said sheet channel and extending about the perimeter of said sheet;

a plurality of unitarily formed elongate fastening members each formed to be a "C"-shaped jaw dimensioned to receive said turned-over edge of said sheet with said filler means positioned within said sheet channel, said jaw being formed to deform unelastically about said edge and said filler upon application of an external crimping force by tool means, said jaw not piercing said sheet to retain said sheet channel with said filler means positioned therein with said "C"- or "U"-shaped jaw, and said fastening members being positioned about the perimeter of said sheet in spaced relation; and a plurality of spring members to resiliently connect one of said fastening members to said frame.

11. A trampoline comprising:

a sheet having an edge which is turned over to form a sheet channel about the perimeter of said sheet;

a rope positioned within said channel and extending about the entire perimeter of said sheet;

a plurality of fastening members mounted about said perimeter of said sheet in spaced relation, each said fastening member including:

a unitary elongate "C" shaped section having a pair of respective oppositely positioned jaws each having a tip, said "C" shaped section defining a "U" shaped interior channel dimensioned to receive said turned over edge of said sheet including said rope positioned within said sheet channel;

each said section having its respective jaws inelastically deformed about said sheet edge, sheet channel and rope by application of a compressive force external from and not integral with said fastening member, said interior channel being inelastically deformed about the perimeter of said turned over sheet edge, said jaw tips each being formed to be a rounded surface, said tips being inelastically crimped about said fabric sheet wherein said sheet is sandwiched between said pair of opposing tips; said sheet being sheltered from being cut by said jaws by said rounded surfaces said fastening members not piercing said sheet;

a ring fixedly mounted to said "C"-shaped section, said ring defining an aperture therein;

a plurality of coil springs, each coil spring having a hooked first end and a hooked second end; said first end being inserted through said aperture and forming a mechanical union with said ring;

a frame, connected to said plurality of coil springs; said second end of each said coil spring being hooked about said frame to form a mechanical union.

* * * * *

UNITED STATES PATENT AND TRADEMARK OFFICE

CERTIFICATE OF CORRECTION

PATENT NO. : 4,863,156

DATED : September 5, 1989

INVENTOR(S) : James L. Shaw

It is certified that error appears in the above-identified patent and that said Letters Patent is hereby corrected as shown below:

Column 4, line 38, change "snuggle" to ---snugly---.

Column 6, line 48, change "tio" to ---to---.

Column 6, line 67, after "area" insert ---(comma),---.

Column 7, line 1, after "base" insert ---(comma),---.

Column 7, line 9, after "and" and before "edge" insert ---said---.

Column 7, line 12, before "each" insert ---(comma),---.

Column 7, line 12, after "each" insert ---(comma),---.

Column 7, line 14, change "resilient" to ---resiliently---.

Column 8, line 9, change "unelastically" to ---inelastically---.

UNITED STATES PATENT AND TRADEMARK OFFICE

CERTIFICATE OF CORRECTION

PATENT NO. : 4,863,156

DATED : September 5, 1989

INVENTOR(S) : James L. Shaw

It is certified that error appears in the above-identified patent and that said Letters Patent is hereby corrected as shown below:

Column 8, line 13, change "with" to ---within---.

Column 8, line 16, after "members" and before "to" insert ---each---.

Signed and Sealed this

Twelfth Day of February, 1991

*Attest:*

HARRY F. MANBECK, JR.

*Attesting Officer*

*Commissioner of Patents and Trademarks*